US007922278B2

(12) United States Patent
Nishizaka

(10) Patent No.: US 7,922,278 B2
(45) Date of Patent: Apr. 12, 2011

(54) IMAGE PRINTING APPARATUS AND METHOD FOR CALIBRATING IMAGE PRINTING APPARATUS

(75) Inventor: Katsuhiko Nishizaka, Kitakyuchu (JP)

(73) Assignee: Seiko Epson Corporation, Tokyo (JP)

( * ) Notice: Subject to any disclaimer, the term of this patent is extended or adjusted under 35 U.S.C. 154(b) by 461 days.

(21) Appl. No.: 12/075,485

(22) Filed: Mar. 12, 2008

(65) Prior Publication Data

US 2008/0225075 A1 Sep. 18, 2008

(30) Foreign Application Priority Data

Mar. 12, 2007 (JP) ..... 2007-062167

(51) Int. Cl.
*B41J 29/393* (2006.01)

(52) U.S. Cl. ..... 347/19

(58) Field of Classification Search ..... 347/5, 19–20, 347/37, 40

See application file for complete search history.

(56) References Cited

U.S. PATENT DOCUMENTS

| | | | | |
|---|---|---|---|---|
| 5,255,987 | A | 10/1993 | Mizuno et al. | |
| 6,966,713 | B2 * | 11/2005 | Kim | 400/76 |
| 7,040,733 | B2 * | 5/2006 | Hin | 347/19 |

FOREIGN PATENT DOCUMENTS

| | | |
|---|---|---|
| JP | 63-307304 | 12/1988 |
| JP | 04-116408 | 4/1992 |
| JP | 05-024320 | 2/1993 |
| JP | 06-293163 | 10/1994 |
| JP | 2002-059602 | 2/2002 |
| JP | 2003-305888 | 10/2003 |
| JP | 2005-074750 | 3/2005 |
| JP | 2005-138337 | 6/2005 |
| JP | 2005-329556 | 12/2005 |

* cited by examiner

*Primary Examiner* — Julian D Huffman
*Assistant Examiner* — Jason S Uhlenhake
(74) *Attorney, Agent, or Firm* — Nutter McClennen & Fish LLP; John J. Penny, V; Christina M. Sperry

(57) ABSTRACT

The invention provides an image printing apparatus including: a printing unit that performs printing on a print target medium; a moving unit that can move in a predetermined main scan direction; an edge-detecting unit that is mounted on the moving unit and outputs, by utilizing photoelectric conversion, a voltage that changes across each edge of the print target medium; a position-detecting unit that detects the position of the moving unit; a reference stage that has one edge and another edge in such a manner that the reference stage has a predetermined reference width therebetween, the reference stage being formed in such a manner that the edge-detecting unit outputs a voltage that changes across each edge of the reference stage; and a calibrating unit that commands the moving unit to move in such a manner that the edge-detecting unit passes through each edge of the reference stage, commands the position-detecting unit to detect the position of the moving unit at a point at which a voltage outputted by the edge-detecting unit changes during the movement of the moving unit as each measured position, calculates a measured width on the basis of the measured positions, and calibrates the edge-detecting unit on the basis of the measured width and the reference width.

10 Claims, 8 Drawing Sheets

IMAGE PRINTING APPARATUS AND METHOD FOR CALIBRATING IMAGE PRINTING APPARATUS

The entire disclosure of Japanese Patent Application No. 2007-062167, filed Mar. 12, 2007 is expressly incorporated by reference herein.

BACKGROUND

1. Technical Field

The present invention relates to an image printing apparatus and a method for calibrating (i.e., correcting) the image printing apparatus.

2. Related Art

In the technical field to which the present invention pertains, an image printing apparatus that has a sensor that is capable of detecting the edges of a sheet of print target paper is known. An example of such an image printing apparatus having a paper-edge detection sensor known in the art is described in JP-A-2003-305888. In a manufacturing process of the related-art image printing apparatus disclosed in JP-A-2003-305888, "black" printing is performed in a print area inside a paper-margin area with a predetermined width of paper margin being left along each edge of a sheet of printing paper. Then, using the paper-edge detection sensor thereof, the related-art image printing apparatus disclosed therein measures a distance between each edge (i.e., border) of the print area and the corresponding edge of the sheet of printing paper. The related-art image printing apparatus disclosed therein stores a difference between the measured distance and a predetermined reference margin width as a calibration value (i.e., correction value). Using the stored calibration value, the related-art image printing apparatus disclosed in JP-A-2003-305888 performs the calibration (i.e., adjustment) of the paper-edge detection sensor thereof.

Disadvantageously, since the sensor-calibration measurement is conducted only once in the manufacturing process thereof, which means that it will not be conducted after the actual use thereof, it is practically impossible, or at best difficult, for the related-art image printing apparatus disclosed in JP-A-2003-305888 to prevent the detection accuracy of the paper-edge detection sensor thereof from decreasing as time elapses due to the aged deterioration of the paper-edge detection sensor thereof. Even if it is modified to conduct the sensor-calibration measurement after the actual use thereof, since it is necessary to perform black printing, the related-art image printing apparatus disclosed in JP-A-2003-305888 disadvantageously consumes considerable amount of a coloring matter such as ink for such a purpose.

SUMMARY

An advantage of some aspects of the invention is to provide an image printing apparatus that is capable of avoiding any substantial decrease in the detection accuracy of the paper-edge detection sensor thereof due to the aged deterioration of the paper-edge detection sensor thereof without using the considerable amount of a coloring matter such as ink. In addition, the invention provides, as an advantage of some aspects thereof, a method for calibrating (i.e., correcting) the image printing apparatus having such a unique and advantageous configuration.

In order to address the above-identified problems without any limitation thereto, the invention adopts any of the following novel and inventive configurations and features.

The invention provides, as a first aspect thereof, an image printing apparatus including: a printing section that performs printing on a print target medium; a moving section that can move in a predetermined main scan direction; an edge-detecting section that is mounted on the moving section and outputs, by utilizing photoelectric conversion, a voltage that changes across each edge of the print target medium; a position-detecting section that detects the position of the moving section; a reference stage that has one edge and another edge in such a manner that the reference stage has a predetermined reference width therebetween, the reference stage being formed in such a manner that the edge-detecting section outputs a voltage that changes across each edge of the reference stage; and a calibrating section that commands the moving section to move in such a manner that the edge-detecting section passes through each edge of the reference stage, commands the position-detecting section to detect the position of the moving section at a point at which a voltage outputted by the edge-detecting section changes during the movement of the moving section as each measured position, calculates a measured width on the basis of the measured positions, and calibrates the edge-detecting section on the basis of the measured width and the reference width.

In the configuration of an image printing apparatus according to the first aspect of the invention, the calibrating section commands the moving section to move in such a manner that the edge-detecting section passes through each edge of the reference stage. The calibrating section commands the position-detecting section to detect the position of the moving section at a point at which a voltage outputted by the edge-detecting section changes during the movement of the moving section as each measured position. The calibrating section calculates a measured width on the basis of the measured positions. Then, the calibrating section calibrates the edge-detecting section on the basis of the measured width and the reference width. Having such a unique configuration, an image printing apparatus according to the first aspect of the invention described above makes it possible for a user to perform calibration after the aged deterioration of the edge-detecting section thereof without requiring any considerable amount of ink consumption for this purpose. Thus, an image printing apparatus according to the first aspect of the invention described above makes it further possible to avoid any substantial decrease in the detection accuracy of the edge-detecting section thereof. Therefore, even in a case where a user specifies very fine margin of a print target medium with rigorous accuracy, an image printing apparatus according to the first aspect of the invention described above ensures that they can obtain a desired print result with precise paper margin in accordance with such strict user settings. In addition thereto, since such calibration can be performed at the side of a user, that is, after shipment thereof, it is possible to omit the factory-calibration (i.e., pre-shipment calibration) of the edge-detecting section in the manufacturing process of an image printing apparatus according to the first aspect of the invention.

In the configuration of an image printing apparatus according to the first aspect of the invention described above, it is preferable that the calibrating section should command the position-detecting section to detect, as a first measured position, the position of the moving section at a point at which a voltage outputted by the edge-detecting section changes during the movement of the moving section in which, as the moving section moves, the edge-detecting section moves from the surface area of the reference stage so as to pass through the above-mentioned one edge of the reference stage, and thereafter, the calibrating section should command the position-detecting section to detect, as a second measured position, the position of the moving section at a point at which a voltage outputted by the edge-detecting section changes during the movement of the moving section in which, as the moving section moves, the edge-detecting section moves from the surface area of the reference stage so as to pass through the above-mentioned another edge of the reference stage; the calibrating section should calculate a calibration value that is determined in proportion to a difference between the measured width, which is calculated on the basis of the first measured position and the second measured position, and the reference width; and the calibrating section should perform calibration by subtracting the calibration value from the position of one edge of the print target medium detected by the edge-detecting section and by adding the calibration value to the position of another edge of the print target medium detected by the edge-detecting section. With such a preferred configuration of an image printing apparatus according to the first aspect of the invention described above, the calibration of the edge-detecting section is performed on the basis a calibration value that is calculated on the basis of a difference, which is computed on the basis of the calculated value of the measured width of the reference stage and the value of the reference width of the reference stage. Therefore, an image printing apparatus having such a preferred configuration realizes simple calibration without requiring the collection of calibration data or the application of any mathematically complex calibration function. Moreover, in the process of making a judgment as to whether a voltage outputted by the edge-detecting section has changed or not on the basis of a comparison of the output voltage level thereof with a judgment threshold value, in the detection of each of the above-mentioned one edge and the above-mentioned another edge thereof, the edge-detecting section moves in a direction from a "detection-target-present region" toward a "detection-target-absent region". Therefore, it is enough to have only one judgment threshold value for detection thereof.

The invention provides, as a second aspect thereof, an image printing apparatus including: a printing section that performs printing on a print target medium; a moving section that can move in a predetermined main scan direction; an edge-detecting section that is mounted on the moving section and outputs, by utilizing photoelectric conversion, a voltage that changes across each edge of the print target medium; a position-detecting section that detects the position of the moving section; a reference stage that has an edge at a predetermined reference position, the reference stage being formed in such a manner that the edge-detecting section outputs a voltage that changes across the edge of the reference stage; and a calibrating section that commands the moving section to move in such a manner that the edge-detecting section passes through the edge of the reference stage, commands the position-detecting section to detect the position of the moving section at a point at which a voltage outputted by the edge-detecting section changes during the movement of the moving section as a measured position, and calibrates the edge-detecting section on the basis of the measured position and the reference position.

In the configuration of an image printing apparatus according to the second aspect of the invention, the calibrating section commands the moving section to move in such a manner that the edge-detecting section passes through the edge of the reference stage. The calibrating section commands the position-detecting section to detect the position of the moving section at a point at which a voltage outputted by the edge-detecting section changes during the movement of the moving section as a measured position. Then, the calibrating section calibrates the edge-detecting section on the basis of the measured position and the reference position. Having such a unique configuration, an image printing apparatus according to the second aspect of the invention described above makes it possible for a user to perform calibration after the aged deterioration of the edge-detecting section thereof without requiring any considerable amount of ink consumption for this purpose. Thus, an image printing apparatus according to the second aspect of the invention described above makes it further possible to avoid any substantial decrease in the detection accuracy of the edge-detecting section thereof. Therefore, even in a case where a user specifies very fine margin of a print target medium with rigorous accuracy, an image printing apparatus according to the second aspect of the invention described above ensures that they can obtain a desired print result with precise paper margin in accordance with such strict user settings. In addition thereto, since such calibration can be performed at the side of a user, that is, after shipment thereof, it is possible to omit the factory-calibration, that is, pre-shipment calibration, of the edge-detecting section in the manufacturing process of an image printing apparatus according to the second aspect of the invention.

In the configuration of an image printing apparatus according to the second aspect of the invention described above, it is preferable that the reference stage should have two edges one of which is provided at a predetermined first reference position whereas another thereof is provided at a predetermined second reference position; the calibrating section should command the position-detecting section to detect, as a first measured position, the position of the moving section at a point at which a voltage outputted by the edge-detecting section changes during the movement of the moving section in which, as the moving section moves, the edge-detecting section moves from the surface area of the reference stage so as to pass through the above-mentioned one edge of the reference stage, and thereafter, the calibrating section should command the position-detecting section to detect, as a second measured position, the position of the moving section at a point at which a voltage outputted by the edge-detecting section changes during the movement of the moving section in which, as the moving section moves, the edge-detecting section moves from the surface area of the reference stage so as to pass through the above-mentioned another edge of the reference stage; the calibrating section should calculate a first calibration value that is determined in proportion to a difference between the first measured position and the first reference position and a second calibration value that is determined in proportion to a difference between the second measured position and the second reference position; and the calibrating section should perform calibration by subtracting the first calibration value from the position of one edge of the print target medium detected by the edge-detecting section, which corresponds to the first reference position, and by adding the second calibration value to the position of another edge of the print target medium detected by the edge-detecting section, which corresponds to the second reference position. With such a preferred configuration of an image printing apparatus according to the second aspect of the invention described above, the calibration of the edge-detecting section is performed on the basis a calibration value that is calculated on the basis of a distance difference. Therefore, an image printing apparatus having such a preferred configuration realizes simple calibration without requiring the collection of calibration data or the application of any mathematically complex calibration function. Moreover, in the process of making a judgment as to whether a voltage outputted by the edge-detecting section has changed or not on the basis of a comparison of the output voltage level thereof with a judgment threshold value, in the detection of each of the above-mentioned one edge and the above-mentioned another edge thereof, the edge-detecting section moves in a direction from a "detection-target-present region" toward a "detection-target-absent region". Therefore, it is enough to have only one judgment threshold value for detection thereof.

In the configuration of the image printing apparatus according to the first aspect of the invention, it is preferable that the edge-detecting section should be a section that outputs a voltage in accordance with the amount of reflected light that is received as a result of reflection of light that has been emitted toward a detection target medium; and the reference stage should be formed in such a manner that a voltage change that occurs at the time of the detection of the edge of the reference stage by the edge-detecting section is substantially the same as a voltage change that occurs at the time of the detection of the edge of the print target medium by the edge-detecting section. With such a configuration, it is possible to perform calibration for the detection of the edges of the print target medium under the same conditions as those defined for the detection of the edges of the reference stage. As another example of a preferred configuration thereof, the optical reflection factor of the surface of the reference stage may be substantially the same as that of the print target medium; and in addition thereto, the height of the reference stage may be set to be the same as that of the print target medium.

In the configuration of an image printing apparatus according to the first aspect of the invention, it is preferable that the reference stage should be provided at a region that does not overlap the print target medium in a plan view. With such a preferred configuration, it is possible to perform calibration even when the print target medium is present at the print position thereof.

In the configuration of an image printing apparatus according to the first aspect of the invention described above, it is preferable that the calibrating section should command the moving section to move so as to detect the measured positions at the time when the power of the image printing apparatus is turned ON and/or at each predetermined time interval after the power ON thereof. In addition thereto, in the configuration of an image printing apparatus according to the first aspect of the invention described above, it is preferable that the calibrating section should calibrate the edge-detecting section on the basis of the measured position and the reference position. With such a preferred configuration, since the calibrating section performs automatic calibration, it is possible to prevent any substantial decrease in the detection accuracy of the edge-detecting section without imposing the burden of any extra job upon a user.

The invention provides, as a third aspect thereof, a method for calibrating an image printing apparatus that has a printing section that performs printing on a print target medium, a moving section that can move in a predetermined main scan direction, an edge-detecting section that is mounted on the moving section and outputs, by utilizing photoelectric conversion, a voltage that changes across each edge of the print target medium, and a reference stage that has one edge and another edge in such a manner that the reference stage has a predetermined reference width therebetween, the reference stage being formed in such a manner that the edge-detecting section outputs a voltage that changes across each edge of the reference stage, the calibration method including: (a) commanding the moving section to move in such a manner that the edge-detecting section passes through each edge of the reference stage, and commanding the position-detecting section to detect the position of the moving section at a point at which a voltage outputted by the edge-detecting section changes during the movement of the moving section as each measured position; (b) calculating a measured width on the basis of the measured positions; and (c) calibrating the edge-detecting section on the basis of the measured width and the reference width.

In a method for calibrating an image printing apparatus according to the third aspect of the invention, the moving section is commanded to move in such a manner that the edge-detecting section passes through each edge of the reference stage. The position-detecting section is commanded to detect the position of the moving section at a point at which a voltage outputted by the edge-detecting section changes during the movement of the moving section as each measured position. A measured width is calculated on the basis of the measured positions. Then, the edge-detecting section is calibrated on the basis of the measured width and the reference width. Having such a unique feature, a method for calibrating an image printing apparatus according to the third aspect of the invention described above makes it possible for a user to perform calibration after the aged deterioration of the edge-detecting section thereof without requiring any considerable amount of ink consumption for this purpose. Thus, a method for calibrating an image printing apparatus according to the third aspect of the invention described above makes it further possible to avoid any substantial decrease in the detection accuracy of the edge-detecting section thereof. Therefore, even in a case where a user specifies very fine margin of a print target medium with rigorous accuracy, a method for calibrating an image printing apparatus according to the third aspect of the invention described above ensures that they can obtain a desired print result with precise paper margin in accordance with such strict user settings. In addition thereto, since such calibration can be performed at the side of a user, that is, after shipment thereof, it is possible to omit the factory-calibration (i.e., pre-shipment calibration) of the edge-detecting section in the manufacturing process of an image printing apparatus according to an aspect of the invention. It should be noted that further step(s) may be added to the above basic steps of the method for calibrating an image printing apparatus according to the third aspect of the invention described above in order to realize operation/working-effects and/or functions that are offered by constituent elements of the image printing apparatus according to the first aspect of the invention described above.

The invention provides, as a fourth aspect thereof, a method for calibrating an image printing apparatus that has a printing section that performs printing on a print target medium, a moving section that can move in a predetermined main scan direction, an edge-detecting section that is mounted on the moving section and outputs, by utilizing photoelectric conversion, a voltage that changes across each edge of the print target medium, and a reference stage that has an edge at a predetermined reference position, the reference stage being formed in such a manner that the edge-detecting section outputs a voltage that changes across the edge of the reference stage, the calibration method including: (a) commanding the moving section to move in such a manner that the edge-detecting section passes through the edge of the reference stage, and commanding the position of the moving section to be detected at a point at which a voltage outputted by the edge-detecting section changes during the movement of the moving section as a measured position; and (b) calibrating the edge-detecting section on the basis of the measured position and the reference position.

In a method for calibrating an image printing apparatus according to the fourth aspect of the invention, the moving section is commanded to move in such a manner that the edge-detecting section passes through the edge of the reference stage. The position-detecting section is commanded to detect the position of the moving section at a point at which a voltage outputted by the edge-detecting section changes during the movement of the moving section as a measured position. Then, the edge-detecting section is calibrated on the basis of the measured position and the reference position. Having such a unique feature, a method for calibrating an image printing apparatus according to the fourth aspect of the invention described above makes it possible for a user to perform calibration after the aged deterioration of the edge-detecting section thereof without requiring any considerable amount of ink consumption for this purpose. Thus, a method for calibrating an image printing apparatus according to the fourth aspect of the invention described above makes it further possible to avoid any substantial decrease in the detection accuracy of the edge-detecting section thereof. Therefore, even in a case where a user specifies very fine margin of a print target medium with rigorous accuracy, a method for calibrating an image printing apparatus according to the fourth aspect of the invention described above ensures that they can obtain a desired print result with precise paper margin in accordance with such strict user settings. In addition thereto, since such calibration can be performed at the side of a user, that is, after shipment thereof, it is possible to omit the factory-calibration, that is, pre-shipment calibration, of the edge-detecting section in the manufacturing process of an image printing apparatus according to an aspect of the invention. It should be noted that further step(s) may be added to the above basic steps of the method for calibrating an image printing apparatus according to the fourth aspect of the invention described above in order to realize operation/working-effects and/or functions that are offered by constituent elements of the image printing apparatus according to the second aspect of the invention described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
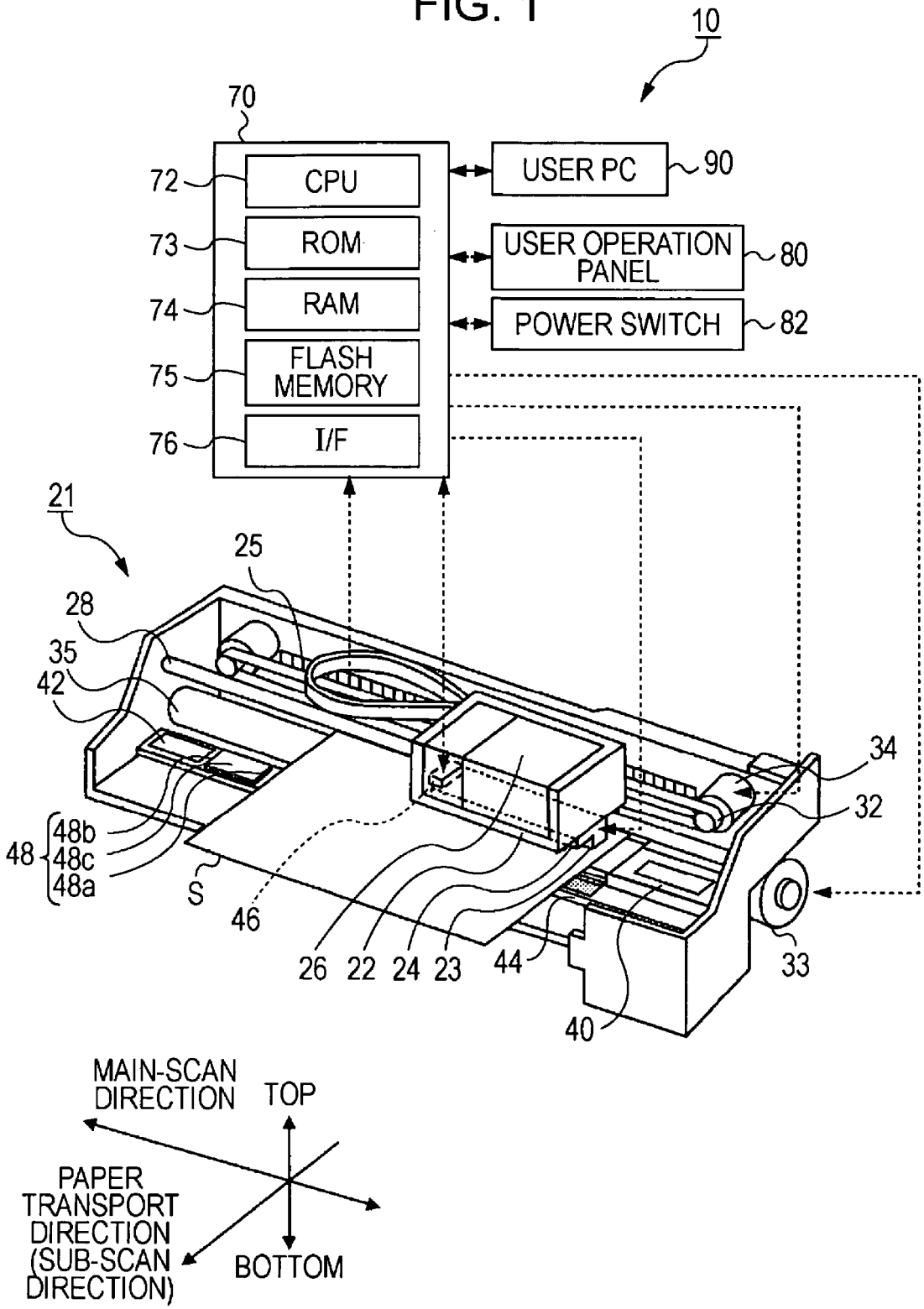
FIG. 1 is a diagram that schematically illustrates an example of the general configuration of an ink-jet printer 10 according to an exemplary embodiment of the invention.
Figure 2:
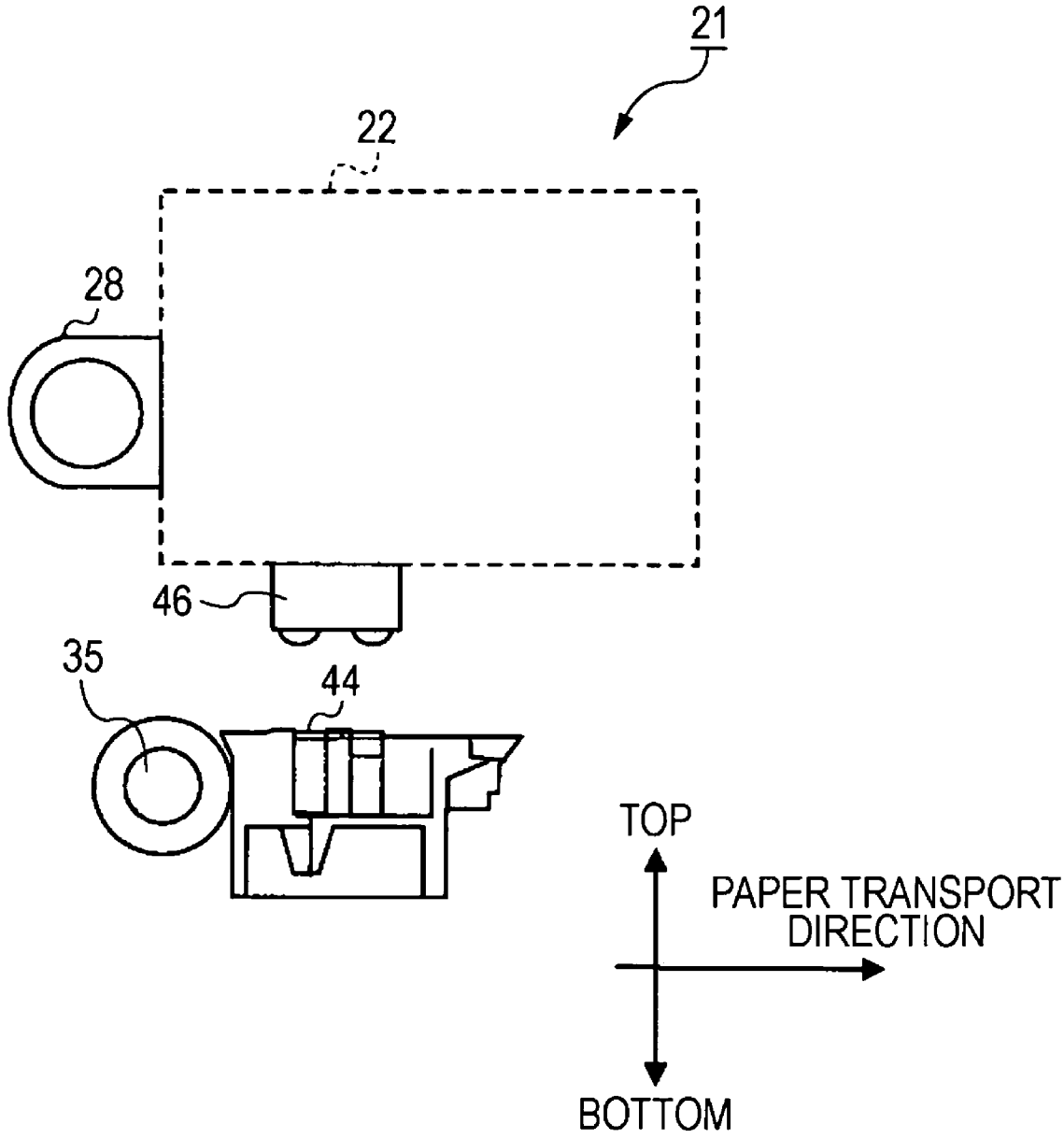
FIG. 2 is a sectional view that schematically illustrates an example of the configuration of the ink-jet printer 10 illustrated in FIG. 1, specifically, the position of a PW detection device 46 according to an exemplary embodiment of the invention.

With reference to accompanying drawings, an exemplary embodiment of the present invention is explained below. FIG. 1 is a diagram that schematically illustrates an example of the general configuration of an ink-jet printer 10 according to an exemplary embodiment of the invention. FIG. 2 is a sectional view that schematically illustrates an example of the configuration of the ink-jet printer 10 illustrated in FIG. 1.

As illustrated in FIG. 1, the ink-jet printer 10 according to the present embodiment of the invention is provided with a printing mechanism 21, a paper-width (hereafter abbreviated as "PW") detection device 46, a reference table 48, a flushing area 42, a capping device 40, a controller 70, and a user operation panel 80. The printing mechanism 21 performs printing on a sheet of print target paper S that is transported over a platen 44 by a paper-transport roller (i.e., paper-feed roller) 35 in a paper-transport direction by discharging ink drops thereon. The paper-transport direction is shown in FIG. 1 as a direction from the distal (i.e., far) side of the ink-jet printer 10 to the proximal (i.e., near) side thereof. The PW detection device 46, which is provided on the left surface of a print head 24, detects both the left edge of a sheet of the print target paper S and the right edge thereof. The reference table 48 and the flushing area 42 are provided adjacent to each other in the proximity of the left end of the platen 44. On the other hand, the capping device 40 is provided in the proximity of the right end of the platen 44. The controller 70 is responsible for controlling the operations of the ink-jet printer 10 as a whole. A user can input various kinds of print instructions/settings by manipulating the user operation panel 80. The user operation panel 80 provides various kinds of print-related information to the user.

As components thereof, the printing mechanism 21 is made up of, though not necessarily limited thereto, a driving motor 33, a carriage 22, a plurality of ink cartridges 26, the print head 24, and a plurality of nozzles 23. The driving motor 33 applies a driving force to the paper-transport roller 35 so as to rotate thereof. The carriage 22 is fixed to a movable carriage belt 32. As a carriage motor 34 supplies a driving force to the carriage belt 32, the carriage 22 reciprocates to the left and the right, that is, in the main-scan direction, along a guide axis 28. The ink cartridges 26 are detachably attached to the carriage 22. Each of the ink cartridges 26 contains ink of the corresponding color, which is, yellow (Y), magenta (M), cyan (C), or black (K). The print head 24 applies pressure to ink that has been supplied thereto from each of the ink cartridges 26. The nozzles 23 discharge ink drops that have been pressurized by the print head 24 onto a sheet of the print target paper S. A linear encoder 25 is provided behind the carriage 22. The linear encoder 25 detects the position of the carriage 22. With such a configuration, the ink-jet printer 10 according to the present embodiment of the invention is capable of controlling (e.g., acquiring information on) the location of the carriage 22 by means of the linear encoder 25. As a non-limiting exemplary configuration of the print head 24 that can be adopted as a substitute for a popular piezoelectric pressure-generating scheme, a thermal pressure-generating scheme may be adopted in which a voltage is applied to an exothermic body such as a heater so as to heat ink. In such a configuration, ink is pressurized by air bubbles that are generated as a result of the heating thereof.

The PW detection device 46 is an optical sensor that is made up of a pair of a light-emitting element and a light-receiving element. The light-emitting element of the PW detection device 46 irradiates light onto a sheet of the print target paper S. A light-emitting diode (LED) is a typical example of the light-source element of the PW detection device 46. The light-receiving element of the PW detection device 46 receives light that has been reflected by the print target paper S and then outputs a voltage that is in proportion to the amount of the received light. As has already been described above, the PW detection device 46 is provided on the left surface of the print head 24. As the carriage 22 travels to the left and to the right, the PW detection device 46 reciprocates together therewith so as to detect both the left edge of a sheet of the print target paper S and the right edge thereof. Specifically, when a detection instruction signal is inputted from the controller 70 into the PW detection device 46, the light-emitting element thereof irradiates light onto the sheet of the print target paper S whereas the light-receiving element thereof receives light that has been reflected by the print target paper S and then outputs a voltage that is in proportion to the amount of the received light to the controller 70 while reciprocating in the main-scan direction.

The reference table 48 is provided at a position outside the effective print area (i.e., printable area) of the platen 44, specifically, for example, at the left outside area thereof as shown in FIG. 1. Information on the length of the reference table 48 measured from the right edge 48*a* thereof to the left edge 48*b* thereof, which is referred to as "reference width" in this specification and in appended claims, is stored in a ROM 73 of the controller 70. The optical reflection factor of the surface area 48*c* of the reference table 48 is substantially the same as that of a sheet of the print target paper S. The height of the reference table 48 is set very slightly higher than that of the platen 44 so as to ensure that the height of a sheet of the print target paper S that is transported over the platen 44 is the same as that of the reference table 48. Because of such a configuration, the vertical distance from the reference table 48 to the PW detection device 46 is substantially the same as the vertical distance from a sheet of the print target paper S to the PW detection device 46.

The flushing area 42, which is used in a so-called flushing operation, is provided to the left of the reference table 48. In the flushing operation, the print head 24 discharges ink drops in a forcible manner regardless of, for example, the presence/absence of print data and content thereof either with a periodic interval or at a given timing in order to prevent ink from becoming dried and thickened at the tips of the nozzles 23.

The capping device 40 is provided at a position outside the printable area of the platen 44, specifically, for example, at the right outside area thereof as shown in FIG. 1. The capping device 40 has a housing that has the shape of a substantially rectangular parallelepiped with an open top. The capping device 40 is used to seal the print head 24 in order to prevent it (i.e., the print head 24) from becoming dried during, for example, a pause in printing. It should be noted that the position on the capping device 40 is referred to as the home position.

As illustrated in FIG. 1, the controller 70 is configured as a microprocessor in which a CPU 72 functions as the central component thereof. In addition to the CPU 72, the controller 70 is provided with the aforementioned ROM 73 that pre-stores various kinds of processing programs including but not limited to a print processing routine and further pre-stores the reference width of the reference table 48, a RAM 74 that temporarily memorizes and/or saves data, a flash memory 75 which data can be written in and erased from, an interface (I/F) 76 that enables the transmission/reception of information to/from an external device, and an input/output (I/O) port that is not shown in the drawing. Various kinds of signals are inputted into the controller 70 via the I/O port that is not shown in the drawing. For example, a control signal is inputted into the controller 70 from the user operation panel 80. A power ON/OFF signal is inputted into the controller 70 from a power switch 82. A detection signal is inputted into the controller 70 from the PW detection device 46. In addition to these signals that are inputted into the controller 70 via the I/O port not shown therein, a printing job, though not limited thereto, is inputted into the controller 70 from a user PC 90 via the I/F 76. In a signal flow reverse to the above, various kinds of signals are outputted from the controller 70 via the I/O port that is not shown in the drawing. For example, the controller 70 outputs a control signal to the print head 24. The controller 70 outputs a control signal to the driving motor 33. The controller 70 outputs a display instruction signal to the user operation panel 80. The controller 70 outputs a detection instruction signal to the PW detection device 46. In addition to these signals that are outputted from the controller 70 via the I/O port not shown therein, print status information, though not limited thereto, is outputted from the controller 70 to the user PC 90 via the I/F 76.

Figure 3:
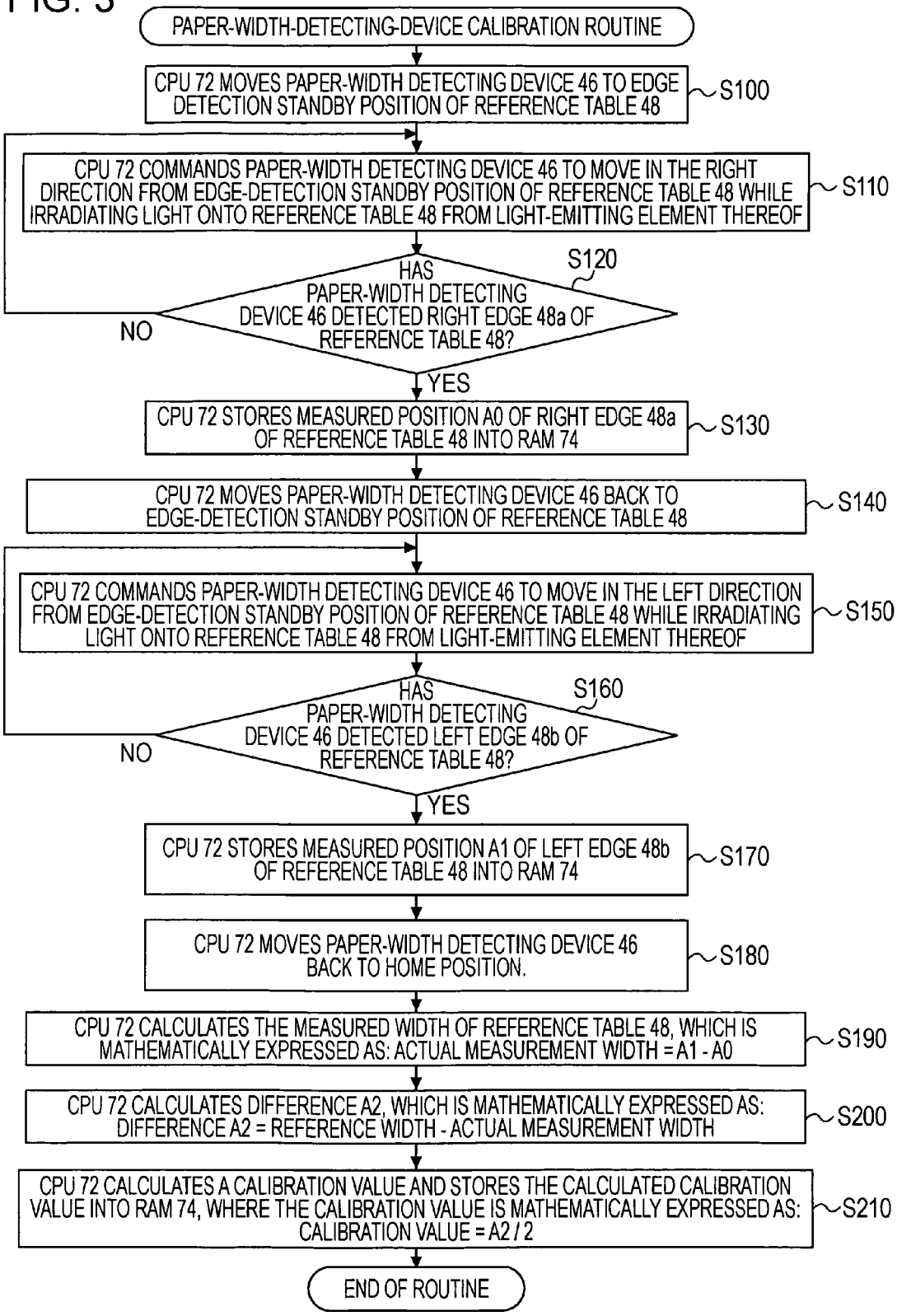
FIG. 3 is a flowchart that illustrates an example of a PW-detection-device calibration routine according to an exemplary embodiment of the invention.

Next, the functional features of the ink-jet printer 10 according to the present embodiment of the invention, which has an exemplary configuration described above, is explained below. In particular, in the following description, it is explained as to how the ink-jet printer 10 according to the present embodiment of the invention detects both the left edge of a sheet of the print target paper S and the right edge thereof by means of the PW detection device 46. First of all, a processing flow for calibrating (i.e., adjusting or correcting) the PW detection device 46, which is hereafter referred to as "PW-detection-device calibration routine", is explained below. FIG. 3 is a flowchart that illustrates an example of the PW-detection-device calibration routine according to the present embodiment of the invention. The PW-detection-device calibration routine is stored in the ROM 73 of the controller 70. This processing flow is executed immediately after the power switch 82 of the ink-jet printer 10 is turned ON, or at each predetermined point in time (i.e., timing) in a repetitive manner. Herein, the term "at each predetermined point in time (i.e., timing)" could mean, though not necessarily limited thereto, a point in time at which a predetermined length of time period has elapsed after the calibration of the PW detection device 46 was carried out in accordance with this processing routine in one implementation example of the invention. In another non-limiting implementation example thereof, the term "at each predetermined point in time (i.e., timing)" may be a point in time at which printing has been completed for a predetermined number of sheets of the print target paper S.

Upon the start of the PW-detection-device calibration routine according to the present embodiment of the invention, as a first step thereof, the CPU 72 drives the carriage motor 34 so as to move the PW detection device 46 from the aforementioned home position to the edge-detection standby position of the reference table 48 (step S100). In the PW-detection-device calibration routine according to the present embodiment of the invention, the position of the PW detection device 46 is determined on the basis of a value indicated by the linear encoder 25 (hereafter referred to as "encoder value"). When the carriage 22 is located at the home position, the encoder value indicates zero. As the carriage 22 moves to the left (refer to FIG. 1) from the home position, the encoder value increases in the positive coordinate. The edge-detection standby position of the reference table 48 is pre-stored in the ROM 73. The edge-detection standby position of the reference table 48 may be at any position as long as the PW detection device 46 can detect the surface area 48*c* of the reference table 48 without failure. In the PW-detection-device calibration routine according to the present embodiment of the invention, it is assumed that the edge-detection standby position of the reference table 48 is set at the substantially central region of the reference table 48. In the next step, the CPU 72 commands the PW detection device 46 to move in the right direction from the edge-detection standby position of the reference table 48 while irradiating light onto the reference table 48 from the light-emitting element thereof (step S110). Then, on the basis of the output voltage of the light-receiving element of the PW detection device 46 that has received reflected light, the CPU 72 makes a judgment as to whether the PW detection device 46 has detected the right edge 48*a* of the reference table 48 or not (step S120). Assuming that the PW detection device 46 is in normal operation conditions, which means that the performance thereof has not yet been affected by aged deterioration, light emitted from the light-emitting element thereof is reflected at the surface area 48*c* of the reference table 48 and then enters the light-receiving element thereof in the form of (incident) reflected light during a time period (or, in other words, within a movement range) from a point in time (i.e., point in location) at which the PW detection device 46 starts to move from the edge-detection standby position of the reference table 48 to a point in time (i.e., point in location) at which the PW detection device 46 reaches the right edge 48*a* of the reference table 48. For this reason, the output voltage of the light-receiving element of the PW detection device 46 is maintained at a predetermined high level during this time period (within this movement range). In contrast thereto, once after the normally operating PW detection device 46 has passed through the right edge 48*a* of the reference table 48, little light or almost no light emitted from the light-emitting element thereof is reflected at the surface area 48*c* of the reference table 48 to enter the light-receiving element thereof in the form of reflected light. Since there is little or almost no incoming reflected light, the output voltage of the light-receiving element of the PW detection device 46 drops to a predetermined low level after the passage thereof. In the PW-detection-device calibration routine according to the present embodiment of the invention, a judgment threshold value is set in a medium output voltage region between the high output voltage level and the low output voltage level. At the time when the actual output voltage of the light-receiving element of the PW detection device 46 reaches the threshold value, the CPU 72 judges that the PW detection device 46 has detected the right edge 48*a* of the reference table 48. If it is judged in the step S120 that the PW detection device 46 has not yet detected the right edge 48*a* of the reference table 48 (step S120: NO), the process returns to the step S110 to continue the movement of the PW detection device 46. If it is judged in the step S120 that the PW detection device 46 has detected the right edge 48*a* of the reference table 48 (step S120: YES), the encoder value measured at that instant is stored in the RAM 74 as the measured position A0 of the right edge 48*a* of the reference table 48 (step S130). Thereafter, the CPU 72 drives the carriage motor 34 so as to move the PW detection device 46 back to the edge-detection standby position of the reference table 48 (step S140).

In the next step, the CPU 72 commands the PW detection device 46 to move in the left direction from the edge-detection standby position of the reference table 48 while irradiating light onto the reference table 48 from the light-emitting element thereof (step S150). Then, on the basis of the output voltage of the light-receiving element of the PW detection device 46 that has received reflected light, the CPU 72 makes a judgment as to whether the PW detection device 46 has detected the left edge 48*b* of the reference table 48 or not (step S160). The same judgment threshold value as that used for judging the detection of the right edge 48*a* of the reference table 48 is set for judging the detection of the left edge 48*b* of the reference table 48. At the time when the actual output voltage of the light-receiving element of the PW detection device 46 reaches the threshold value, the CPU 72 judges that the PW detection device 46 has detected the left edge 48*b* thereof. If it is judged in the step S160 that the PW detection device 46 has not yet detected the left edge 48*b* of the reference table 48 (step S160: NO), the process returns to the step S150 to continue the movement of the PW detection device 46. If it is judged in the step S160 that the PW detection device 46 has detected the left edge 48*b* of the reference table 48 (step S160: YES), the encoder value measured at that instant is stored in the RAM 74 as the measured position A1 of the left edge 48*b* of the reference table 48 (step S170). Thereafter, the CPU 72 drives the carriage motor 34 so as to return the PW detection device 46 to the home position (step S180). In the next step (step S190), the CPU 72 subtracts the value of the measured position (i.e., position based on actual measurement) A0 of the right edge 48*a* of the reference table 48 from the value of the measured position A1 of the left edge 48*b* thereof so as to calculate the measured width (i.e., width based on actual measurement) of the reference table 48, which is mathematically expressed as: (A1−A0). Then, the CPU 72 subtracts the calculated value of the measured width (A1−A0) of the reference table 48 from the value of the reference width of the reference table 48, which is pre-stored in the ROM 73 as has already been mentioned earlier, so as to calculate a difference A2 (step S200). In the next step (step S210), the CPU 72 calculates a calibration value (i.e., correction value or adjustment value) that is obtained as a result of dividing the difference A2 by two. The calibration value is mathematically expressed as: (A2/2). Then, in the same step S210, the CPU stores the calculated calibration value (A2/2) into the RAM 74 and then ends the PW-detection-device calibration routine.

Next, the relationship between the aged deterioration of the PW detection device 46 and the calibration value is explained below. In a desirable state where the performance of the PW detection device 46 has not yet been affected by aged deterioration, the voltage of the light-receiving element of the PW detection device 46 that is outputted therefrom during a time period (or, in other words, within a movement range) from a point in time (i.e., point in location) at which the PW detection device 46 starts to move from the edge-detection standby position of the reference table 48 to a point in time (i.e., point in location) at which the PW detection device 46 reaches the right edge 48*a* of the reference table 48 or the left edge 48*b* thereof is at the same level as that obtained under the normal operation conditions of the PW detection device 46. For this reason, assuming that the performance of the PW detection device 46 has not yet been affected by aged deterioration, the value of the reference width of the reference table 48 equals the value of the measured width (A1−A0) thereof, which results in the difference A2 of zero. Since the difference A2 is zero under such an assumption, the calibration value is also zero. On the other hand, as the level of the output voltage of the light-receiving element of the PW detection device 46 becomes lower than that obtained under the normal operation conditions thereof due to aged deterioration, the measurement position A0 of the right edge 48*a* of the reference table 48 obtained after the aged deterioration thereof is located at a leftward point as viewed from the corresponding "non-aged" position of the right edge 48*a* of the reference table 48 obtained under the normal operation conditions thereof. In like manner, as the level of the output voltage of the light-receiving element of the PW detection device 46 becomes lower than that obtained under the normal operation conditions thereof due to aged deterioration, the measurement position A1 of the left edge 48*b* of the reference table 48 obtained after the aged deterioration thereof is located at a rightward point as viewed from the corresponding non-aged position of the left edge 48*b* of the reference table 48 obtained under the normal operation conditions thereof. Therefore, assuming that the performance of the PW detection device 46 has been affected by aged deterioration so that the level of the output voltage of the light-receiving element of the PW detection device 46 has become lower than that obtained under the normal operation conditions thereof, the value of the measured width (A1−A0) of the reference table 48 is smaller than the value of the reference width thereof. As a result thereof, the difference A2 takes a positive value. Since the difference A2 is positive under such an assumption, the calibration value is also positive. Meanwhile, as the level of the output voltage of the light-receiving element of the PW detection device 46 becomes higher than that obtained under the normal operation conditions thereof due to some reasons, the measurement position A0 of the right edge 48*a* of the reference table 48 obtained under such a condition is located at a rightward point as viewed from the corresponding position of the right edge 48*a* of the reference table 48 obtained under the normal operation conditions thereof. In like manner, as the level of the output voltage of the light-receiving element of the PW detection device 46 becomes higher than that obtained under the normal operation conditions thereof due to some reasons, the measurement position A1 of the left edge 48*b* of the reference table 48 obtained under such a condition is located at a leftward point as viewed from the corresponding position of the left edge 48*b* of the reference table 48 obtained under the normal operation conditions thereof. Therefore, assuming that the level of the output voltage of the light-receiving element of the PW detection device 46 has become higher than that obtained under the normal operation conditions thereof for some reasons, the value of the measured width (A1−A0) of the reference table 48 is larger than the value of the reference width thereof. As a result thereof, the difference A2 takes a negative value. Since the difference A2 is negative under such an assumption, the calibration value is also negative.

Figure 4:
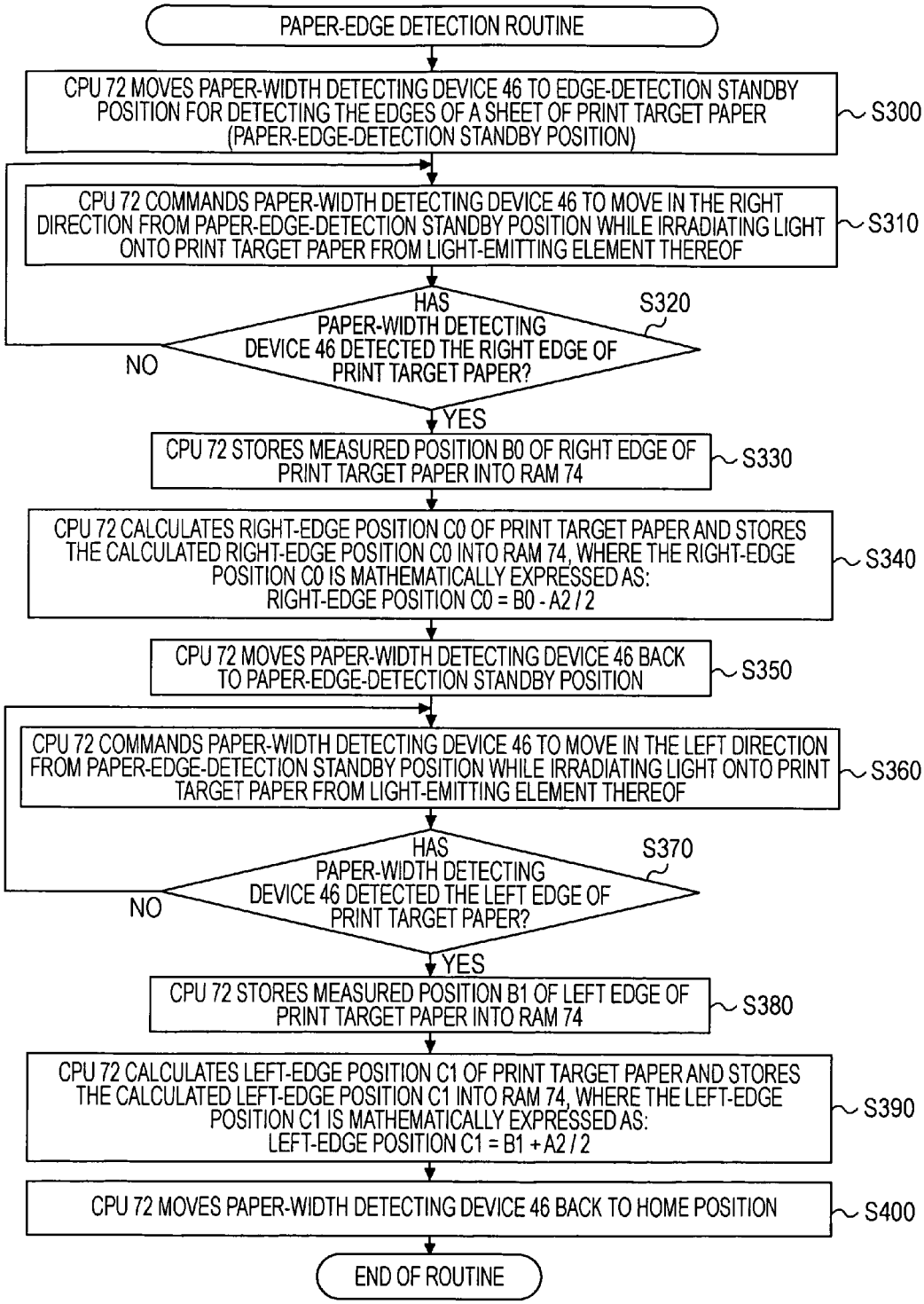
FIG. 4 is a flowchart that illustrates an example of a paper-edge detection routine according to an exemplary embodiment of the invention.

Next, a processing flow for detecting the edges of a sheet of the print target paper S, which is hereafter referred to as "paper-edge detection routine", is explained below. FIG. 4 is a flowchart that illustrates an example of the paper-edge detection routine according to the present embodiment of the invention. The paper-edge detection routine is stored in the ROM 73 of the controller 70. The CPU 72 thereof executes this processing flow at the time when a printing job is inputted into the controller 70 from the user PC 90 via the I/F 76 and further when a sheet of the print target paper S is fed from a paper-feed tray, which is not shown in the drawing, to a predetermined position.

Upon the start of the paper-edge detection routine according to the present embodiment of the invention, as a first step thereof, the CPU 72 drives the carriage motor 34 so as to move the PW detection device 46 from the aforementioned home position to the paper-edge-detection standby position for detecting the edges of the sheet of the print target paper S (step S300). The paper-edge-detection standby position is prestored in the ROM 73 for each available size of a sheet of the print target paper S, which is specified in a printing job. The paper-edge-detection standby position may be at any position as long as the PW detection device 46 can detect the print target surface of a sheet of the print target paper S without failure. In the paper-edge detection routine according to the present embodiment of the invention, it is assumed that the paper-edge-detection standby position is set at the substantially central region of a sheet of the print target paper S. In the next step, the CPU 72 commands the PW detection device 46 to move in the right direction from the paper-edge-detection standby position while irradiating light onto the sheet of the print target paper S from the light-emitting element thereof (step S310). Then, on the basis of the output voltage of the light-receiving element of the PW detection device 46 that has received reflected light, the CPU 72 makes a judgment as to whether the PW detection device 46 has detected the right edge of the sheet of the print target paper S or not (step S320). The same judgment threshold value as that used for judging the detection of the right edge 48*a* of the reference table 48 is set for judging the detection of the right edge of the sheet of the print target paper S. At the time when the actual output voltage of the light-receiving element of the PW detection device 46 reaches the threshold value, the CPU 72 judges that the PW detection device 46 has detected the right edge of the sheet of the print target paper S. If it is judged in the step S320 that the PW detection device 46 has not yet detected the right edge of the sheet of the print target paper S (step S320: NO), the process returns to the step S310 to continue the movement of the PW detection device 46. If it is judged in the step S320 that the PW detection device 46 has detected the right edge of the sheet of the print target paper S (step S320: YES), the encoder value measured at that instant is stored in the RAM 74 as the measured position B0 of the right edge of the sheet of the print target paper S (step S330). Then, the CPU 72 calculates the right-edge position C0 of the sheet of the print target paper S, which is obtained as a result of subtracting the calibration value (A2/2), which was calculated in the preceding PW-detection-device calibration routine described above and stored in the RAM 74, from the measured position B0 of the right edge of the sheet of the print target paper S (step S340). That is, the right-edge position C0 of the sheet of the print target paper S is mathematically expressed as: (B0−A2/2). In the same step S340, the CPU 72 stores the calculated right-edge position C0 thereof into the RAM 74. Thereafter, the CPU 72 drives the carriage motor 34 so as to move the PW detection device 46 back to the paper-edge-detection standby position (step S350).

In the next step, the CPU 72 commands the PW detection device 46 to move in the left direction from the paper-edge-detection standby position while irradiating light onto the sheet of the print target paper S from the light-emitting element thereof (step S360). Then, on the basis of the output voltage of the light-receiving element of the PW detection device 46 that has received reflected light, the CPU 72 makes a judgment as to whether the PW detection device 46 has detected the left edge of the sheet of the print target paper S or not (step S370). The same judgment threshold value as that used for judging the detection of the left edge 48*b* (i.e., right edge 48*a*) of the reference table 48 is set for judging the detection of the left edge of the sheet of the print target paper S. At the time when the actual output voltage of the light-receiving element of the PW detection device 46 reaches the threshold value, the CPU 72 judges that the PW detection device 46 has detected the left edge of the sheet of the print target paper S. If it is judged in the step S370 that the PW detection device 46 has not yet detected the left edge of the sheet of the print target paper S (step S370: NO), the process returns to the step S360 to continue the movement of the PW detection device 46. If it is judged in the step S370 that the PW detection device 46 has detected the left edge of the sheet of the print target paper S (step S370: YES), the encoder value measured at that instant is stored in the RAM 74 as the measured position B1 of the left edge of the sheet of the print target paper S (step S380). Then, the CPU 72 calculates the left-edge position C1 of the sheet of the print target paper S, which is obtained as a result of adding the calibration value (A2/2), which was calculated in the preceding PW-detection-device calibration routine described above and stored in the RAM 74, to the measured position B1 of the left edge of the sheet of the print target paper S (step S390). That is, the left-edge position C1 of the sheet of the print target paper S is mathematically expressed as: (B1+A2/2). In the same step S390, the CPU 72 stores the calculated left-edge position C1 thereof into the RAM 74. Thereafter, the CPU 72 drives the carriage motor 34 so as to return the PW detection device 46 to the home position (step S400). Then, the CPU 72 ends the paper-edge detection routine. With the series of the above-described steps, the paper-edge detection routine according to the present embodiment of the invention makes it possible to detect the left and right edges of a sheet of the print target paper S with a significantly enhanced precision. Thus, if a user specifies the left-edge margin width of a sheet of the print target paper S as 3 mm and the right-edge margin width thereof as 3 mm, too, which is a non-limiting example of user margin settings, an image printing apparatus and a method for calibrating thereof according to an aspect of the invention ensure that they can obtain a desired print result with precise paper margin in accordance with the user settings.

Figure 5:
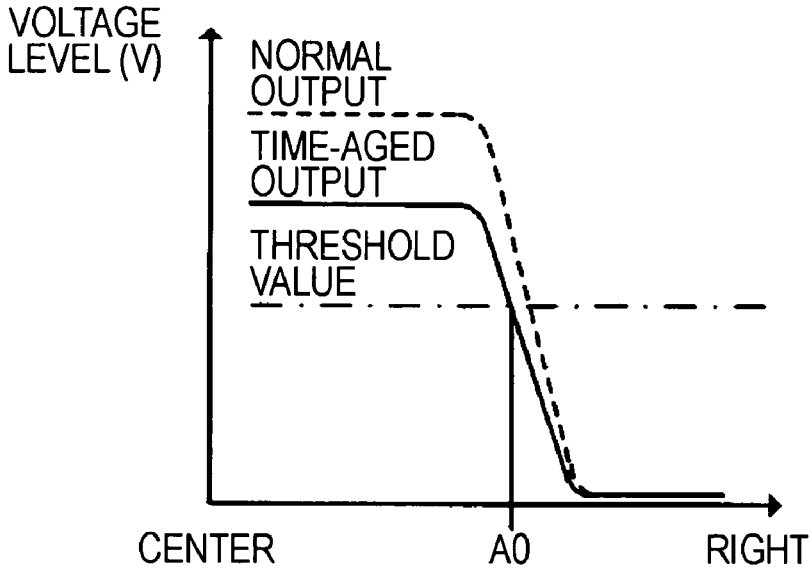
FIG. 5 is a graph that shows an example of a change in the level of the voltage of the light-receiving element of the PW detection device 46 that is outputted during a process in which the PW detection device 46 detects the right edge 48*a* of a reference table 48 according to an exemplary embodiment of the invention.
Figure 6:
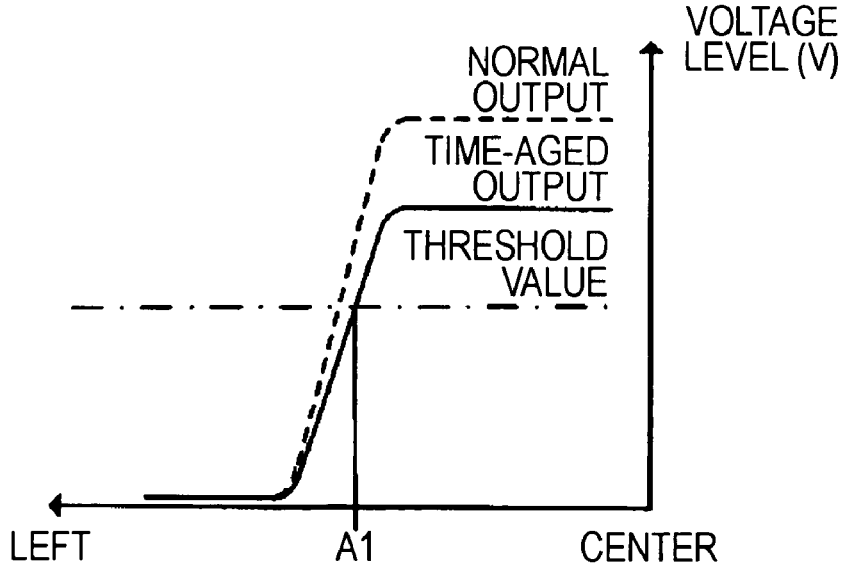
FIG. 6 is a graph that shows an example of a change in the level of the voltage of the light-receiving element of the PW detection device 46 that is outputted during a process in which the PW detection device 46 detects the left edge 48*b* of the reference table 48 according to an exemplary embodiment of the invention.
Figure 7:
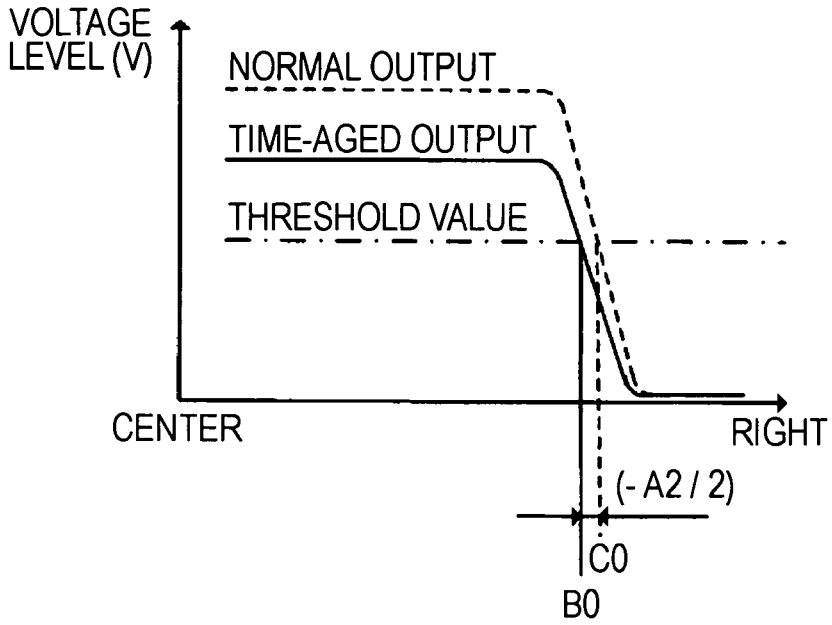
FIG. 7 is a graph that shows an example of a change in the level of the voltage of the light-receiving element of the PW detection device 46 that is outputted during a process in which the PW detection device 46 detects the right edge of a sheet of a print target paper S according to an exemplary embodiment of the invention.
Figure 8:
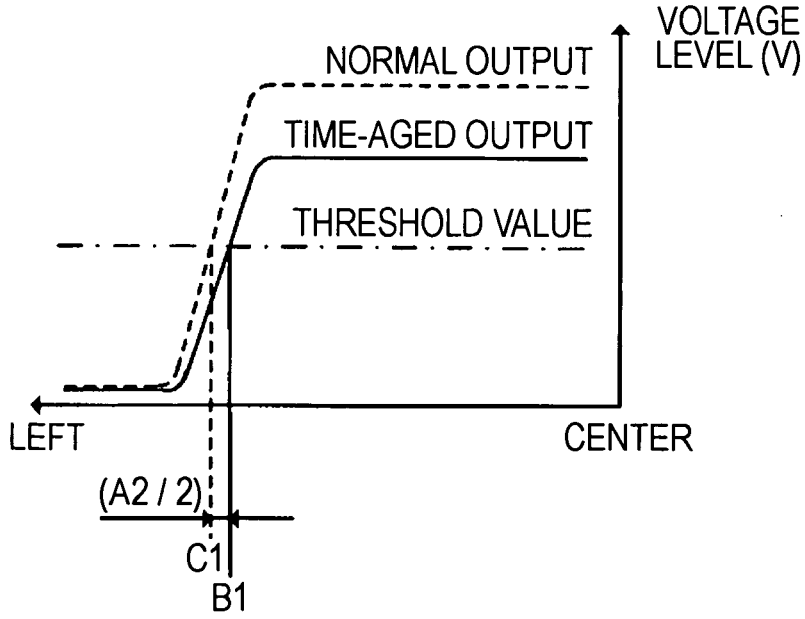
FIG. 8 is a graph that shows an example of a change in the level of the voltage of the light-receiving element of the PW detection device 46 that is outputted during a process in which the PW detection device 46 detects the left edge of a sheet of the print target paper S according to an exemplary embodiment of the invention.

In this paragraph, an explanation is given below of the calibration (i.e., correction or adjustment) of the PW detection device 46 that is conducted when the level of the output voltage of the light-receiving element of the PW detection device 46 has become lower than that obtained under the normal operation conditions thereof due to aged deterioration. FIG. 5 is a graph that shows an example of a change in the level of the voltage of the light-receiving element of the PW detection device 46 that is outputted during a process in which the PW detection device 46 detects the right edge 48*a* of the reference table 48 according to an exemplary embodiment of the invention. As shown in FIG. 5, a point at which the level curve of the output voltage of the light-receiving element of the PW detection device 46 that is obtained after aged deterioration intersects with a threshold line, that is, a point at which the level of the output voltage of the light-receiving element of the PW detection device 46 that is obtained after aged deterioration reaches the aforementioned judgment threshold value (i.e., the actually measured position A0 of the right edge 48*a* of the reference table 48) is located at a leftward point as viewed from the corresponding "non-aged" position of the right edge 48*a* of the reference table 48 obtained under the normal operation conditions thereof. FIG. 6 is a graph that shows an example of a change in the level of the voltage of the light-receiving element of the PW detection device 46 that is outputted during a process in which the PW detection device 46 detects the left edge 48*b* of the reference table 48 according to an exemplary embodiment of the invention. As shown in FIG. 6, a point at which the level curve of the output voltage of the light-receiving element of the PW detection device 46 that is obtained after aged deterioration intersects with a threshold line, that is, a point at which the level of the output voltage of the light-receiving element of the PW detection device 46 that is obtained after aged deterioration reaches the aforementioned judgment threshold value (i.e., the actually measured position A1 of the left edge 48*b* of the reference table 48) is located at a rightward point as viewed from the corresponding non-aged position of the left edge 48*b* of the reference table 48 obtained under the normal operation conditions thereof. Therefore, assuming that the performance of the PW detection device 46 has been affected by aged deterioration so that the level of the output voltage of the light-receiving element of the PW detection device 46 has become lower than that obtained under the normal operation conditions thereof, the value of the measured width (A1−A0) of the reference table 48 is smaller than the value of the reference width thereof. As a result thereof, the difference A2 takes a positive value. Since the difference A2 is positive under such an assumption, the calibration value is also positive. FIG. 7 is a graph that shows an example of a change in the level of the voltage of the light-receiving element of the PW detection device 46 that is outputted during a process in which the PW detection device 46 detects the right edge of a sheet of the print target paper S according to an exemplary embodiment of the invention. As shown in FIG. 7, a point at which the level curve of the output voltage of the light-receiving element of the PW detection device 46 that is obtained after aged deterioration intersects with a threshold line, that is, a point at which the level of the output voltage of the light-receiving element of the PW detection device 46 that is obtained after aged deterioration reaches the aforementioned judgment threshold value (i.e., the actually measured position B0 of the right edge of a sheet of the print target paper S) is located at a leftward point as viewed from the corresponding non-aged position of the right edge of the sheet of the print target paper S obtained under the normal operation conditions thereof. Thus, the calibrated right-edge position C0 of the sheet of the print target paper S, which is obtained as a result of subtracting the calibration value (A2/2) from the measured right-edge position B0 of the sheet of the print target paper S, takes a value that is smaller than the measured position B0 thereof because of the subtraction. Through the subtraction of the calibration value (A2/2) from the measured position B0, the measurement value is calibrated (i.e., corrected or adjusted) in such a manner that it is shifted to the right. Thus, the calibrated right-edge position C0 of the sheet of the print target paper S according to the present embodiment of the invention is substantially the same position as the corresponding non-aged position of the right edge of the sheet of the print target paper S that is obtained under the normal operation conditions thereof. FIG. 8 is a graph that shows an example of a change in the level of the voltage of the light-receiving element of the PW detection device 46 that is outputted during a process in which the PW detection device 46 detects the left edge of a sheet of the print target paper S according to an exemplary embodiment of the invention. As shown in FIG. 8, a point at which the level curve of the output voltage of the light-receiving element of the PW detection device 46 that is obtained after aged deterioration intersects with a threshold line, that is, a point at which the level of the output voltage of the light-receiving element of the PW detection device 46 that is obtained after aged deterioration reaches the aforementioned judgment threshold value (i.e., the actually measured position B1 of the left edge of a sheet of the print target paper S) is located at a rightward point as viewed from the corresponding non-aged position of the left edge of the sheet of the print target paper S obtained under the normal operation conditions thereof. Thus, the calibrated left-edge position C1 of the sheet of the print target paper S, which is obtained as a result of adding the calibration value (A2/2) to the measured left-edge position B1 of the sheet of the print target paper S, takes a value that is larger than the measured position B1 thereof because of the addition. Through the addition of the calibration value (A2/2) to the measured position B1, the measurement value is calibrated in such a manner that it is shifted to the left. Thus, the calibrated left-edge position C1 of the sheet of the print target paper S according to the present embodiment of the invention is substantially the same position as the corresponding non-aged position of the left edge of the sheet of the print target paper S that is obtained under the normal operation conditions thereof.

In this paragraph, the corresponding relationships between component units described in an exemplary embodiment of the invention and constituent elements according to an aspect of the invention are explained. The ink-jet printer 10 that is described in an exemplary embodiment of the invention corresponds to an "image printing apparatus" according to an aspect of the invention. The printing mechanism 21 that is described in an exemplary embodiment of the invention corresponds to a "printing section" according to an aspect of the invention. The carriage 22 that is described in an exemplary embodiment of the invention corresponds to a "moving section" according to an aspect of the invention. The PW detection device 46 that is described in an exemplary embodiment of the invention corresponds to an "edge-detecting section" according to an aspect of the invention. The linear encoder 25 that is described in an exemplary embodiment of the invention corresponds to a "position-detecting section" according to an aspect of the invention. Finally, the CPU 72 that is described in an exemplary embodiment of the invention corresponds to a "calibrating section" according to an aspect of the invention. It should be noted that the explanation of the operations of the ink-jet printer 10 according to an exemplary embodiment of the invention given above provides a descriptive and illustrative support for not only an image printing apparatus according to an aspect of the invention but also a method for calibrating the image printing apparatus according to an aspect of the invention.

In the configuration of the ink-jet printer 10 according to the present embodiment of the invention described above, the calibration of the PW detection device 46 is performed as follows. The linear encoder 25 detects the location of the carriage 22 at the moment of a change in the level of the output voltage of the light-receiving element of the PW detection device 46, which occurs at the time when the PW detection device 46 passes through each of the right edge 48*a* of the reference table 48 and the left edge 48*b* thereof as a measured position, which is a position based on actual measurement thereof. Then, the CPU 72 calculates the measured width, which is a width based on actual measurement, of the reference table 48. Next, the CPU 72 calculates the difference A2 on the basis of the calculated value of the measured width of the reference table 48 and the value of the reference width of the reference table 48. Finally, on the basis of a calibration value that is calculated on the basis of the difference A2, the CPU 72 calibrates the PW detection device 46. Having such a unique configuration, the ink-jet printer 10 according to the present embodiment of the invention makes it possible for a user to perform calibration after the aged deterioration of the PW detection device 46 thereof without requiring any considerable amount of ink consumption for this purpose unlike the related-art image printing apparatus disclosed in JP-A-2003-305888. Thus, the ink-jet printer 10 according to the present embodiment of the invention makes it further possible to avoid any substantial decrease in the detection accuracy of the PW detection device 46 thereof. Therefore, even in a case where a user specifies very fine margin of a sheet of the print target paper S with rigorous accuracy, the ink-jet printer 10 according to the present embodiment of the invention ensures that they can obtain a desired print result with precise paper margin in accordance with such strict user settings. In addition thereto, since such calibration can be performed at the side of a user, that is, after shipment thereof, it is possible to omit the factory-calibration (i.e., pre-shipment calibration) of the PW detection device 46 in the manufacturing process of the ink-jet printer 10.

In addition, in the configuration of the ink-jet printer 10 according to the present embodiment of the invention described above, the calibration of the PW detection device 46 is performed on the basis a calibration value that is calculated on the basis of the difference A2, which is computed on the basis of the calculated value of the measured width of the reference table 48 and the value of the reference width of the reference table 48. Therefore, the ink-jet printer 10 according to the present embodiment of the invention realizes simple calibration without requiring the collection of calibration data or the application of any mathematically complex calibration function. Moreover, in the process of left/right edge detection, the PW detection device 46 moves in a direction from a "detection-target-present region" toward a "detection-target-absent region". Therefore, it is enough to have only one judgment threshold value for detection thereof.

Furthermore, in the configuration of the ink-jet printer 10 according to the present embodiment of the invention described above, the optical reflection factor of the surface of the reference table 48 is substantially the same as that of a sheet of the print target paper S; and in addition thereto, the height of the reference table 48 is set to be the same as that of the sheet of the print target paper S. With such a configuration, it is possible to perform calibration for the detection of the edges of the sheet of the print target paper S under the same conditions as those defined for the detection of the edges of the reference table 48.

Still furthermore, in the configuration of the ink-jet printer 10 according to the present embodiment of the invention described above, the reference table 48 is provided at a region that does not overlap a sheet of the print target paper S in a plan view. Therefore, it is possible to perform calibration even when a sheet of the print target paper S is present at the print position thereof.

Still furthermore, in the configuration of the ink-jet printer 10 according to the present embodiment of the invention described above, the CPU 72 executes calibration procedure immediately after the power switch 82 of the ink-jet printer 10 is turned ON and/or at each predetermined point in time (i.e., timing) after the power ON thereof. Therefore, it is possible to prevent any substantial decrease in the detection accuracy of the PW detection device 46 without imposing the burden of any extra job upon a user.

Still furthermore, in the configuration of the ink-jet printer 10 according to the present embodiment of the invention described above, the PW detection device 46 is calibrated on the basis of the measured width of the reference table 48 and the reference width of the reference table 48, where the former width is calculated on the basis of the measured positions A0 and A1. Therefore, the ink-jet printer 10 according to the present embodiment of the invention does not require a high precision in the mounting position of the reference table 48. Therefore, it is possible to easily mount the reference table 48 onto the ink-jet printer 10.

Needless to say, the invention should be in no case understood to be restricted to any exemplary embodiment thereof described above. That is, the invention may be configured or implemented in an adaptable manner in a variety of variations or modifications thereof without departing from the spirit thereof, which should be deemed to be encompassed within the technical scope thereof.

Figure 9A:
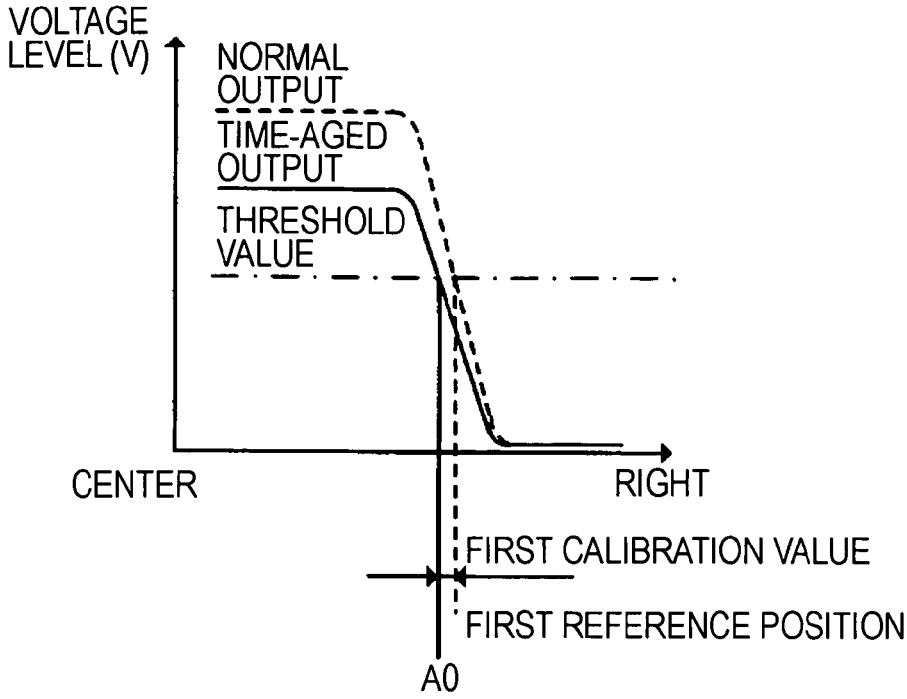
FIGS. 9A and 9B is a set of graphs that shows an example of the calibration of the PW detection device 46 according to an exemplary embodiment of the invention.
Figure 9B:
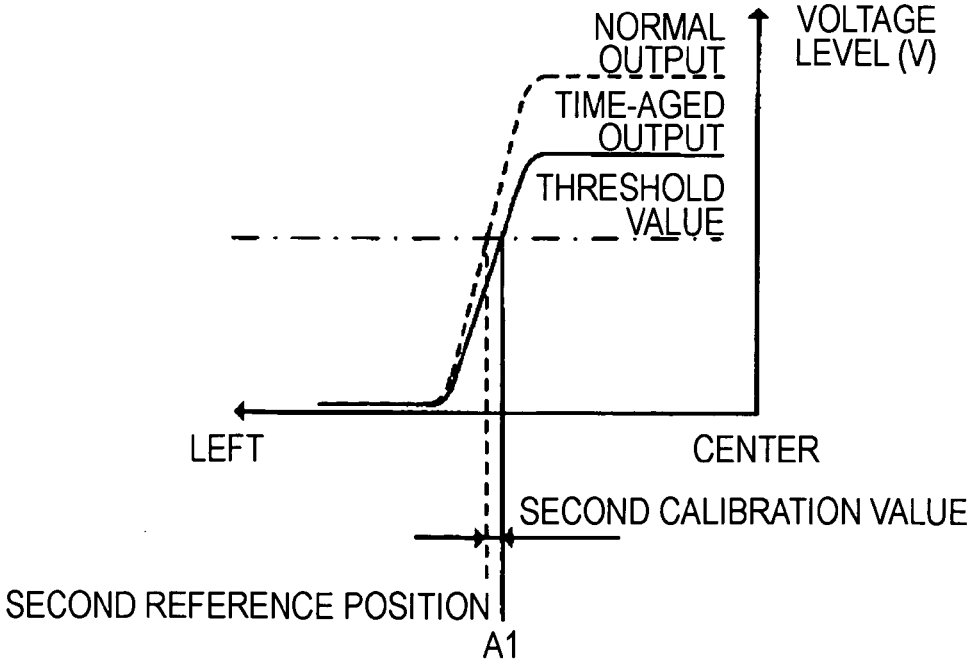

In the configuration of the ink-jet printer 10 according to the present embodiment of the invention described above, the distance from the right edge 48*a* of the reference table 48 to the left edge 48*b* thereof is given (i.e., set) as the reference width of the reference table 48. However, the scope of the invention is not limited to such an exemplary configuration. Instead of using such a pre-defined reference width, the following non-limiting modified reference acquisition may be adopted. In a modified example, the PW detection device 46 detects the right edge 48*a* of the reference table 48 and the left edge 48*b* thereof before the ink-jet printer 10 is shipped from a factory or before a user uses the ink-jet printer 10 for the first time. Then, the encoder values obtained at the instant of the detection of the right edge 48*a* of the reference table 48 and the left edge 48*b* thereof are stored into the ROM 73 as a first reference position and a second reference position, respectively. After the initial use thereof, the PW detection device 46 further detects the right edge 48*a* of the reference table 48 and the left edge 48*b* thereof and then stores the encoder values obtained at the instant of the detection thereof into the ROM 73 as a first actual measurement position and a second actual measurement position, respectively. Then, a first difference is calculated by subtracting the first reference position from the first actual measurement position. The calculated first difference is used as a first calibration value. Similarly, a second difference is calculated by subtracting the second reference position from the second actual measurement position. The calculated second difference is used as a second calibration value. An example of a change in the level of the voltage of the light-receiving element of the PW detection device 46 according to a modification example described in this paragraph is illustrated in FIGS. 9A and 9B. FIG. 9A is a graph that shows an example of a change in the level of the voltage of the light-receiving element of the PW detection device 46 that is outputted during a process in which the first difference is calculated by subtracting the first reference position from the first actual measurement position A0 of the right edge 48*a* of the reference table 48, and then, the calculated first difference is used as the first calibration value according to a modification example of the invention. FIG. 9B is a graph that shows an example of a change in the level of the voltage of the light-receiving element of the PW detection device 46 that is outputted during a process in which the second difference is calculated by subtracting the second reference position from the second actual measurement position A1 of the left edge 48*b* of the reference table 48, and then, the calculated second difference is used as the second calibration value according to the modification example of the invention. Then, the calibrated right-edge position C0 of a sheet of the print target paper S is obtained as a result of subtracting the first calibration value from the actual measurement position B0 of the sheet of the print target paper S that is obtained when the PW detection device 46 detects the right edge thereof. On the other hand, the calibrated left-edge position C1 of the sheet of the print target paper S is obtained as a result of subtracting the second calibration value from the actual measurement position B1 of the sheet of the print target paper S that is obtained when the PW detection device 46 detects the left edge thereof. With such a modified calibration, it is possible to obtain the same advantageous effects as those of the foregoing exemplary embodiment of the invention. In this modification example, because the first calibration value is substantially the same as the second calibration value, both edges of a sheet of the print target paper S may be calibrated by means of either one of the first calibration value and the second calibration value. If so configured, it is possible to complete the calculation of a calibration value more speedily.

Figure 10:
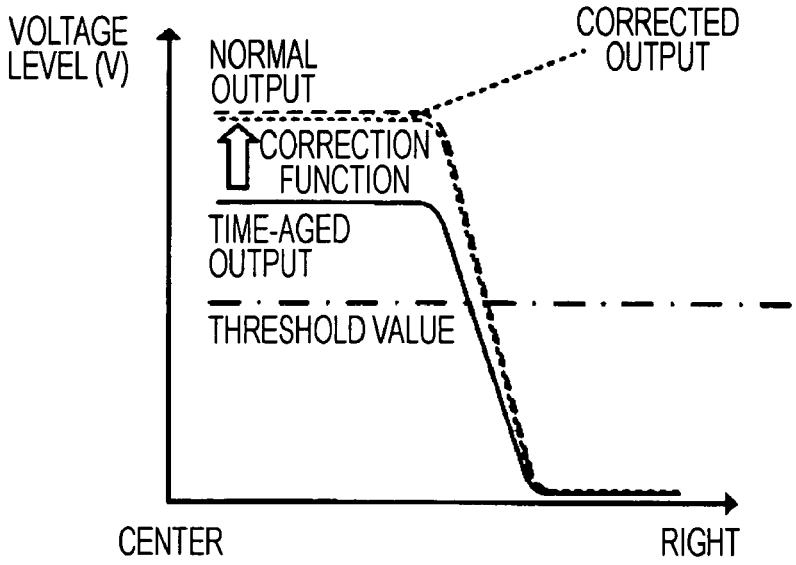
FIG. 10 is a graph that shows another example of the calibration of the PW detection device 46 according to an exemplary embodiment of the invention.
Figure 11:
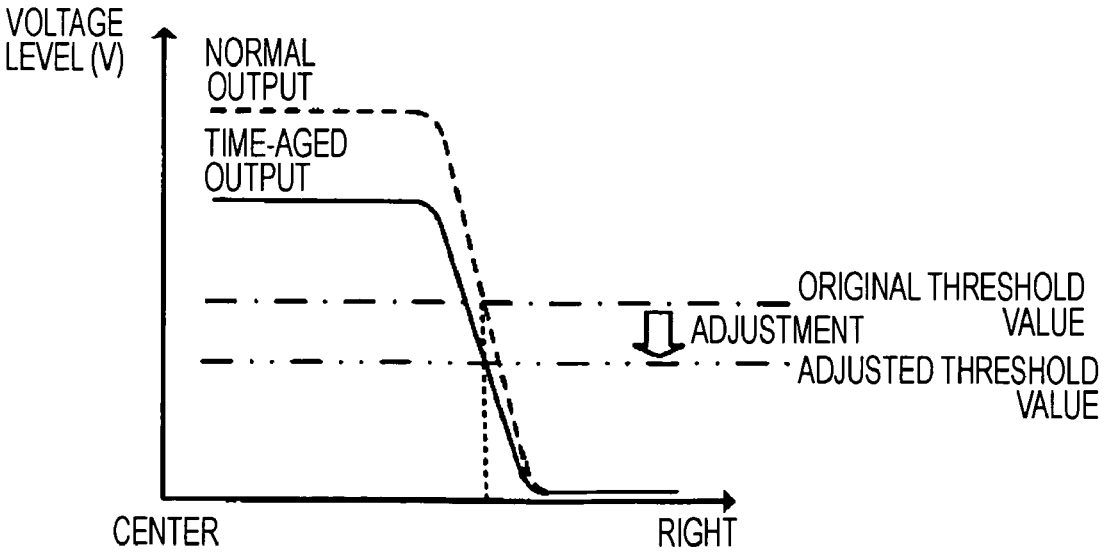
FIG. 11 is a graph that shows still another example of the calibration of the PW detection device 46 according to an exemplary embodiment of the invention.

In the configuration of the ink-jet printer 10 according to the present embodiment of the invention described above, calibration is performed as a result of addition/subtraction of a calibration value. However, the scope of the invention is not limited to such an exemplary configuration. As one modification example thereof, the level of an output voltage may be corrected instead of addition/subtraction of a calibration value. As another modification example thereof, the value of a judgment threshold may be adjusted in accordance with an output voltage instead of addition/subtraction of a calibration value. FIG. 10 is a graph that shows an example of correcting the level of the output voltage of the light-receiving element of the PW detection device 46 so that it approximates to the level thereof that is obtained under normal operation conditions on the basis of a correction function, which is applied after the level of the output voltage of the light-receiving element of the PW detection device 46 has become lower than that obtained under the normal operation conditions thereof due to, for example, aged deterioration. In the process of detecting the edges of a sheet of the print target paper S, a detection judgment is made on the basis of the "calibrated" output voltage that is corrected by means of the correction function. FIG. 11 is a graph that shows an example of adjusting the value of a judgment threshold, which is applied after the level of the output voltage of the light-receiving element of the PW detection device 46 has become lower than that obtained under the normal operation conditions thereof due to, for example, aged deterioration. As understood from the drawing, the judgment threshold value is adjusted in such a manner that the level curve of the "age-deteriorated" output voltage intersects with the adjusted threshold line at the same X-axis position as the intersection of the level curve of the normal output voltage and the original threshold line. In the process of detecting the edges of a sheet of the print target paper S, a detection judgment is made on the basis of the "calibrated" threshold value. With such a threshold-value adjustment, it is possible to obtain the same advantageous effects as those of the foregoing exemplary embodiment of the invention.

In the foregoing exemplary embodiment of the invention, the ink-jet printer 10 is provided with the reference table 48. Notwithstanding the foregoing, calibration may be performed by utilizing the reference width of the fringe of the flushing area 42.

In the foregoing exemplary embodiment of the invention, the ink-jet printer 10 is taken as an example of an image printing apparatus according to an aspect of the invention. In addition to the above-described ink-jet printing scheme, a thermal printing scheme including but not limited to a thermal transfer printing scheme and a thermo-sensitive printing scheme, a dot-impact printing scheme, or an electro-photographic printing scheme may be adopted.

What is claimed is:

1. An image printing apparatus comprising:

a printing section that performs printing on a print target medium;

a moving section that can move in a predetermined main scan direction;

an edge-detecting section that is mounted on the moving section and outputs, by utilizing photoelectric conversion, a voltage that changes across each edge of the print target medium;

a position-detecting section that detects a position of the moving section;

a reference stage that has one edge and another edge in such a manner that the reference stage has a predetermined reference width therebetween, the reference stage being formed in such a manner that the edge-detecting section outputs a voltage that changes across each edge of the reference stage; and a calibrating section that commands the moving section to move in such a manner that the edge-detecting section passes through the one edge and the another edge of the reference stage, commands the position-detecting section to detect the position of the moving section at a point at which a voltage outputted by the edge-detecting section changes during movement of the moving section at each measured position, calculates a measured width based on each measured position, and calibrates the edge-detecting section based on the measured width and the reference width;

wherein the calibrating section commands the position-detecting section to detect, as a first measured position, the position of the moving section at a point at which a voltage outputted by the edge-detecting section changes during the movement of the moving section in which, as the moving section moves, the edge-detecting section moves from a surface area of the reference stage so as to pass through the one edge of the reference stage, and thereafter, the calibrating section commands the position-detecting section to detect, as a second measured position, the position of the moving section at a point at which a voltage outputted by the edge-detecting section changes during the movement of the moving section in which, as the moving section moves, the edge-detecting section moves from the surface area of the reference stage so as to pass through the another edge of the reference stage;

the calibrating section calculates a calibration value in proportion to a difference between the measured width and the reference width; and the calibrating section performs calibration by subtracting the calibration value from a position of one edge of the print target medium detected by the edge-detecting section and by adding the calibration value to a position of another edge of the print target medium detected by the edge-detecting section.

2. The image printing apparatus according to claim 1, wherein the edge-detecting section is a section that outputs a voltage in accordance with the amount of reflected light that is received as a result of reflection of light that has been emitted toward a detection target medium; and the reference stage is formed in such a manner that a voltage change that occurs at the time of the detection of the edge of the reference stage by the edge-detecting section is substantially the same as a voltage change that occurs at the time of the detection of the edge of the print target medium by the edge-detecting section.

3. The image printing apparatus according to claim 1, wherein the reference stage is provided at a region that does not overlap the print target medium in a plan view.

4. The image printing apparatus according to claim 1, wherein the calibrating section commands the moving section to move so as to detect the measured positions at the time when the power of the image printing apparatus is turned ON and/or at each predetermined time interval after the power ON thereof.

5. An image printing apparatus comprising:

a printing section that performs printing on a print target medium;

a moving section that can move in a predetermined main scan direction;

an edge-detecting section that is mounted on the moving section and outputs, by utilizing photoelectric conversion, a voltage that changes across each edge of the print target medium;

a position-detecting section that detects a position of the moving section;

a reference stage that has an edge at predetermined reference position, the reference stage being formed in such a manner that the edge-detecting section outputs a voltage that changes across the edge of the reference stage; and a calibrating section that commands the moving section to move in such a manner that the edge-detecting section passes through the one edge and the another edge of the reference stage, commands the position-detecting section to detect the position of the moving section at a point at which a voltage outputted by the edge-detecting section changes during movement of the moving section at a measured position, and calibrates the edge-detecting section based on the measured position and the reference position;

wherein the reference stage has two edges one of which is provided at a predetermined first reference position whereas another thereof is provided at a predetermined second reference position;

the calibrating section commands the position-detecting section to detect, as a first measured position, the position of the moving section at a point at which a voltage outputted by the edge-detecting section changes during the movement of the moving section in which, as the moving section moves, the edge-detecting section moves from a surface area of the reference stage so as to pass through the one edge of the reference stage, and thereafter, the calibrating section commands the position-detecting section to detect, as a second measured position, the position of the moving section at a point at which a voltage outputted by the edge-detecting section changes during the movement of the moving section in which, as the moving section moves, the edge-detecting section moves from the surface area of the reference stage so as to pass through the another edge of the reference stage;

the calibrating section calculates a first calibration value in proportion to a difference between the first measured position and the first reference position and a second calibration value; and the calibrating section performs calibration by subtracting the first calibration value from a position of one edge of the print target medium detected by the edge-detecting section, which corresponds to the first reference position, and by adding the second calibration value to a position of another edge of the print target medium detected by the edge-detecting section, which corresponds to the second reference position.

6. An image printing apparatus comprising:

a printing mechanism that performs printing on a print target medium;

a carriage that can move in a predetermined main scan direction;

an paper-width detection device that is mounted on the carriage and outputs, by utilizing photoelectric conversion, a voltage that changes across each edge of the print target medium;

a linear encoder that detects a position of the carriage;

a reference stage that has one edge and another edge in such a manner that the reference stage has a predetermined reference width therebetween, the reference stage being formed in such a manner that the paper-width detection device outputs a voltage that changes across each edge of the reference stage; and a central processing unit that commands the carriage to move in such a manner that the paper-width detection device passes through the one edge and the another edge of the reference stage, commands the linear encoder to detect the position of the carriage at a point at which a voltage outputted by the paper-width detection device changes during movement of the carriage at each measured position, calculates a measured width based on each measured position, and calibrates the paper-width detection device based on the measured width and the reference width;

wherein the central processing unit commands the linear encoder to detect, as a first measured position, the position of the carriage at a point at which a voltage outputted by the paper-width detection device changes during the movement of the carriage in which, as the carriage moves, the paper-width detection device moves from a surface area of the reference stage so as to pass through the one edge of the reference stage, and thereafter, the central processing unit commands the linear encoder to detect, as a second measured position, the position of the carriage at a point at which a voltage outputted by the paper-width detection device changes during the movement of the carriage in which, as the carriage moves, the paper-width detection device moves from the surface area of the reference stage so as to pass through the another edge of the reference stage;

the central processing unit calculates a calibration value in proportion to a difference between the measured width and the reference width; and the central processing unit performs calibration by subtracting the calibration value from a position of one edge of the print target medium detected by the paper-width detection device and by adding the calibration value to a position of another edge of the print target medium detected by the paper-width detection device.

7. The image printing apparatus according to claim 6, wherein the paper-width detection device is a device that outputs a voltage in accordance with the amount of reflected light that is received as a result of reflection of light that has been emitted toward a detection target medium; and the reference stage is formed in such a manner that a voltage change that occurs at the time of the detection of the edge of the reference stage by the paper-width detection device is substantially the same as a voltage change that occurs at the time of the detection of the edge of the print target medium by the paper-width detection device.

8. The image printing apparatus according to claim 6, wherein the reference stage is provided at a region that does not overlap the print target medium in a plan view.

9. The image printing apparatus according to claim 6, wherein the central processing unit commands the carriage to move so as to detect the measured positions at the time when the power of the image printing apparatus is turned ON and/or at each predetermined time interval after the power ON thereof.

10. An image printing apparatus comprising:

a printing mechanism that performs printing on a print target medium;

a carriage that can move in a predetermined main scan direction;

an paper-width detection device that is mounted on the carriage and outputs, by utilizing photoelectric conversion, a voltage that changes across each edge of the print target medium;

a linear encoder that detects a position of the carriage;

a reference stage that has an edge at a predetermined reference position, the reference stage being formed in such a manner that the paper-width detection device outputs a voltage that changes across the edge of the reference stage; and a central processing unit that commands the carriage to move in such a manner that the paper-width detection device passes through the one edge and the another edge of the reference stage, commands the linear encoder to detect the position of the carriage at a point at which a voltage outputted by the paper-width detection device changes during movement of the carriage at a measured position, and calibrates the paper-width detection device based on the measured position and the reference position;

wherein the reference stage has two edges one of which is provided at a predetermined first reference position whereas another thereof is provided at a predetermined second reference position;

the central processing unit commands the linear encoder to detect, as a first measured position, the position of the carriage at a point at which a voltage outputted by the paper-width detection device changes during the movement of the carriage in which, as the carriage moves, the paper-width detection device moves from a surface area of the reference stage so as to pass through the one edge of the reference stage, and thereafter, the central processing unit commands the linear encoder to detect, as a second measured position, the position of the carriage at a point at which a voltage outputted by the paper-width detection device changes during the movement of the carriage in which, as the carriage moves, the paper-width detection device moves from the surface area of the reference stage so as to pass through the another edge of the reference stage;

the central processing unit calculates a first calibration value in proportion to a difference between the first measured position and the first reference position and a second calibration value; and the central processing unit performs calibration by subtracting the first calibration value from a position of one edge of the print target medium detected by the paper-width detection device, which corresponds to the first reference position, and by adding the second calibration value to a position of another edge of the print target medium detected by the paper-width detection device, which corresponds to the second reference position.

* * * * *